US005241906A

United States Patent [19]

Kansaku

[11] Patent Number: 5,241,906

[45] Date of Patent: Sep. 7, 1993

[54] FEEDER APPARATUS FOR WEB ROTARY PRESS

[75] Inventor: Toshio Kansaku, Sagamihara, Japan

[73] Assignee: Kabushiki Kaisha Tokyo Kikai Seisakusho, Minato, Japan

[21] Appl. No.: 2,327

[22] Filed: Jan. 8, 1993

[30] Foreign Application Priority Data

Jul. 8, 1992 [JP] Japan ..... 4-206126

[51] Int. Cl.[5] ..... B41F 13/54

[52] U.S. Cl. ..... 101/228; 226/120; 226/110; 242/129.6; 242/55; 242/58; 242/55.3

[58] Field of Search ..... 101/138, 143, 178, 219, 101/227, 228; 226/4, 101, 120, 137, 138, 152, 110, 115; 242/55, 55.01, 180, 182, 55.3, 57.1, 58, 129.6

[56] References Cited

U.S. PATENT DOCUMENTS

| | | | |
|---|---|---|---|
| 2,357,259 | 8/1944 | Huck et al. | 242/58 |
| 2,973,914 | 3/1961 | Beninger et al. | 242/58 |
| 3,229,631 | 1/1966 | Peterson | 101/228 |
| 3,386,672 | 6/1968 | Lamon et al. | 242/55 |
| 3,587,461 | 6/1971 | Polglase | 101/228 |
| 3,865,296 | 2/1975 | Alverson | 226/110 |
| 3,880,372 | 4/1975 | Witte | 226/110 |
| 4,261,786 | 4/1981 | Martin et al. | 226/120 |

FOREIGN PATENT DOCUMENTS 61-148849 9/1986 Japan .

*Primary Examiner*—Eugene H. Eickholt

*Attorney, Agent, or Firm*—Trexler, Bushnell, Giangiorgi & Blackstone, Ltd.

[57] ABSTRACT

A feeder apparatus for a web rotary press includes a pair of web supporting arms mounted on a main shaft supported on left and right frames and independently movable along the main shaft by interpositioning of an elongated key and by meshing of a rack provided along the main shaft and pinions provided in boss sections of respective arms. The feeder apparatus further comprises arm shifting means for rotatingly driving respective of pinions independently, the arm shifting means including driving portions arranged at or in the vicinity of the boss sections of respective arms, arm shifting stop position detecting means including sensors provided on respective arms and marking portions provided on predetermined positions of the main shaft corresponding to both of variation of the width of webs to be installed and variation of installation positions thereof, for generating a command for stopping shifting of the arms when a detecting signal attained in relation to shifting of respective arms and a predetermined signal are coincident with each other, and arm fixing means in response to the command for releasably fixing respective arms at stop positions on the main shaft.

10 Claims, 4 Drawing Sheets

FEEDER APPARATUS FOR WEB ROTARY PRESS

BACKGROUND OF THE INVENTION

1. Field of the Invention

The present invention relates to a feeder apparatus for feeding a web to a printing station of a rotary press. More specifically, the invention relates to a feeder apparatus which can be installed webs having different widths. Further particularly, the invention relates to a feeder apparatus which automates shifting of a web supporting arm and shifting of pre-drive mechanism corresponding to shifting of the web supporting arm.

2. Description of the Related Art

Conventionally, a feeder apparatus which can be installed webs of different width has typically been employed in a newspaper press, for example. The different width of webs includes a full width (W width) web Pa having a width corresponding to 4 newspaper pages, ¾ width web Pb having a width corresponding to 3 newspaper pages, ½ width web Pc having a width corresponding to 2 newspaper pages and so forth, as shown in FIG. 7. These different width of webs are selectively used depending upon page layout of the newspaper. The feeder apparatus is thus variable of installation position of the web relative to the center L of the apparatus. The construction permitting variation of the installation position of the webs generally comprises a rack provided along a main shaft supported on both of left and right frames, and pinions mounted on a pair of arms and engaging with the rack. By manual operation, the pinions are rotated to shift the arms on the main shaft.

On the other hand, in the newspaper press, an automatic splicing apparatus is typically employed for splicing a plurality of webs in sequence. The automatic splicing apparatus pre-drives the new web to be spliced for acceleration so that the peripheral speed thereof becomes consistent with that of the old web upon splicing the old and new webs.

Accordingly, on the outer peripheral surface of the web to be pre-driven, an adhesive pasting margin for splicing and a non-pasting margin for permitting contact of a driving belt are provided. When the contact position of the web driving belt has to be varied associating with shifting of a pair of web supporting arms along the main shaft, the belt is shifted preliminarily in consideration of the predetermined position adjustment so that the belt will not contact with the adhesive pasting margin but certainly contact with the non-pasting margin.

The shifting means for a pair of web supporting arms and the driving means for the web are operated manually by personnel for positioning and fixing at the desired position.

On the other hand, Japanese Unexamined Utility Model Publication (Kokai) No. 61-18849 discloses a technology for automating shifting of the web supporting arms. Namely, in the disclosed technology, for a pair of web supporting arms opposingly mounted on the main shaft extending between left and right frames, a screw rods of the corresponding number to that of the arms are provided along the main shaft. The screw rods are engaged with half nuts built-in the respective arms. The screw rods are alternately driven by a common rotary drive means. In addition, a position sensor is provided at a predetermined position to detect a marking body which shifts together with the arms to cause a drive termination signal to stop the arms at the predetermined position. Then, the arm is fixed in place by the self-locking effect of the screw.

As set forth above, the shifting means of the web supporting arms and the web drive mechanism are generally adapted to manual operation and thus substantially labor intensive work. For the newspaper printing industry which requires quick process and quick notification, it is one of most important problems to be solved.

The automated shifting means for the web supporting arm as disclosed in the above-identified Japanese Unexamined Utility Model Publication No. 61-18849 significantly improves the conventional apparatus which required manual operation. However, since the proposed apparatus employs a shifting adjusting system, in which two screw rods are provided along the main shaft and alternately driven by the common drive means provided on one of the side frame, the mechanism is relatively complicate and large and cannot perform simultaneous adjustment for both of the left and right arms to cause substantial period and attention. Also, it does not permit switching into the manual operation in the case of failure in the power transmitting portion. Furthermore, although the disclosed system utilizes the self-locking of the screw, it is still possible to cause uncontrolled rotation of the screw rods due to vibration generated during printing operation. Therefore, the prior proposed apparatus lacks reliability and certainty in maintenance of the predetermined position.

SUMMARY OF THE INVENTION

Therefore, it is an object of the present invention to provide a feeder apparatus which maintains the conventional manual operation mechanism as much as possible in automating a shifting means of web supporting arms and a web driving mechanism and can achieve automation economically and with simple construction.

Another object of the invention is to provide feeder apparatus which permits simultaneous adjustment of the web supporting arms and thus contributes improvement in efficiency and performance.

A further object of the invention is to provide a feeder apparatus which can be easily change over from automated operation to manual operation upon occurrence of failure.

A still further object of the present invention is to provide a feeder apparatus which can successfully prevent the web supporting arms from causing play movement during printing operation for providing satisfactorily high reliability and contributing for energy saving and labor saving.

In order to accomplish the above-mentioned and other objects, the present invention is based on the conventional feeder apparatus for a web rotary press, which includes a pair of web supporting arms mounted on a main shaft supported on left and right frames and independently movable along the main shaft by interpositioning of an elongated key and by meshing of a rack provided along the main shaft and pinions provided in boss sections of respective arms.

According to the present invention, the feeder apparatus further comprises arm shifting means for rotatingly driving respective of pinions independently, the arm shifting means including driving portions arranged at or in the vicinity of the boss sections of respective arms, arm shifting stop position detecting means including sensors provided on respective arms and marking portions provided on predetermined positions of the main shaft corresponding to both of variation of the width of webs to be installed and variation of installation positions thereof, for generating a command for stopping shifting of the arms when a detecting signal attained in relation to shifting of respective arms and a predetermined signal are coincident with each other, and arm fixing means in response to the command for releasably fixing respective arms at stop positions on the main shaft.

It is preferred that a shaft supporting the pinion has a polygonal shaft portion for manual operation.

Furthermore, the arm shifting means may include a torque limiter or a clutch provided between the pinion and the shaft thereof for blocking torque transmission therebetween in response to fixing of the arm by the fixing means.

In the preferred construction, the markings provided on the main shaft are provided at three positions for a left side arm and at another three positions for a right side arm.

According to the present invention, the feeder apparatus may further comprise web driving means including a guide bar supported by the left and right frames in parallel relationship to the main shaft, a base frame supported by the guide bar for shifting in axial direction of the guide bar, an endless belt mounted on the base frame for contacting and releasing to and from the peripheral surface of the web and a driving portion for driving the endless belt, base frame shifting means including a drive portion, for shifting the base frame along the guide bar, brake frame shifting stop position detecting means including a plurality of sensors arranged at a plurality of pre-selected positions adapted to variation of the width of the web to be installed and variation of the installation position, markings provided on the base frame, for generating a stop command for stopping shifting of the base frame when a detection signal attained in relation to shifting of the base frame and a predetermined set signal are coincident to each other, and base frame fixing means for releasably fixing the base frame on the guide bar in response to the stop command.

Preferably, the base frame shifting means comprises a rack provided on the guide bar, a pinion provided on the base frame and meshing with the rack and a driving portion for rotatingly driving the shaft of the pinion.

In the preferred construction, the shaft of the pinion includes a polygonal shaft portion for manual operation.

In addition, the base frame shifting means includes a torque limiter or a clutch provided between the pinion and the shaft thereof for blocking torque transmission therebetween in response to fixing of the base frame by the fixing means.

BRIEF DESCRIPTION OF THE DRAWINGS

The present invention will be understood more fully from the detailed description given herebelow and from the accompanying drawings of the preferred embodiment of the invention, which, however, should not be taken to be limitative to the invention but are for explanation and understanding only.

In the drawings.

DESCRIPTION OF THE PREFERRED EMBODIMENT

Figure 1:
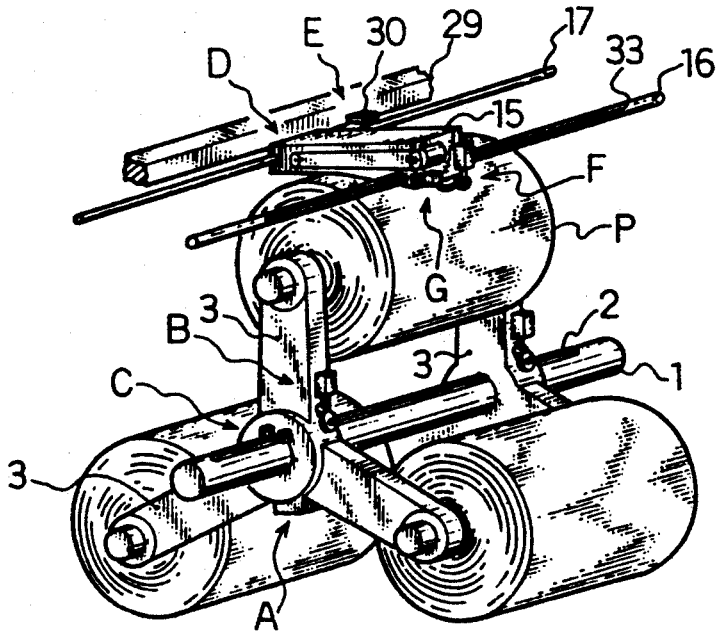
FIG. 1 is a fragmentary perspective view of the preferred embodiment of a feeder apparatus for implementing the present invention.

Referring now to the drawings, particularly to FIGS. 1 to 4, a main shaft 1 is supported on not shown left and right frames. A key groove is formed on the upper peripheral surface of the main shaft 1. The key groove extends in a length at least longer than the width of a full width web Pa (see FIG. 7). A key 2 is engaged to the key groove. The key 2 is, in turn, engaged to key grooves formed on the inner periphery of boss sections of a pair of left and right arms 3, 3. Accordingly, the pair of arms 3, 3 are supported in a condition shiftable in the axial direction and restricted from rotation.

On the other hand, the pair of arms 3, 3 have respectively three arm sections which radially extend from the outer circumference of the boss sections with 120° of angular interval. Center collars 3*a* are mounted on tip ends of respective arm sections. Webs P are installed between opposing center collars 3*a*, 3*a* of the pair of left and right arms 3, 3.

As set forth above, the kinds of the web P to be installed between the pair of arms can be a full width web Pa having the widest width, a ¾ width web Pb having a next wider width and a ½ width web Pc having the narrowest width in case of newspaper printing, for example.

Figure 7:
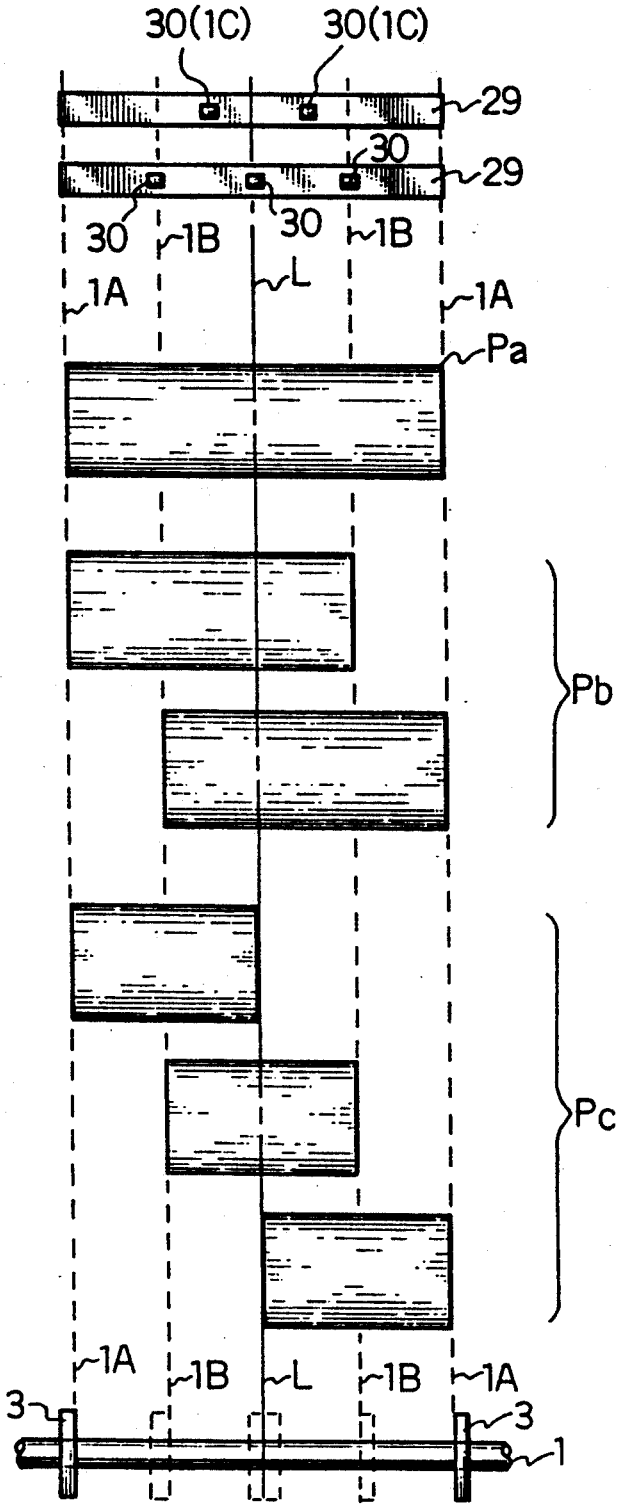
FIG. 7 is an explanatory illustration showing relative relationship between a position (lower portion of the drawing) on a main shaft variable depending on variation of the width of a web to be installed and web installation position (intermediate portion of the drawing) and a corresponding web drive means position (upper side of the drawing) corresponding to the foregoing positions.

The variation of the position for installing the web between the pair of arms 3,3, has to correspond to variation of the width of the web P and variation of the installation position. FIG. 7 diagrammatically illustrates the positional relationships.

In FIG. 7. the full width web Pa is installed on the arms 3, 3 positioned at the outermost positions 1A, 1A on the main shaft 1. At this position, only one installation position can be taken. In case of the ¾ width web Pb, the web is installed on the arms, one of which is positioned at the outermost position 1A and the other of which is placed at an intermediate position 1B inwardly shifted from the outermost position in the magnitude of ¼ of the full width. Therefore, in this case, the installation position can be selected among two positions, i.e. one position shifted toward left and the other position shifted toward right. In case of the ½ width web Pc, it can be installed on the arms 3, 3 at the arm positions, where one of the arms is positioned at the outermost position and the other of the arm is positioned at the intermediate position corresponding to the center L of apparatus, and in the alternative can be installed on the arms 3, 3 both of which are placed at the intermediate positions 1B, 1B. Therefore, the ½ width web Pc can be installed at three positions.

In other words, expressing the installation position of the web by the positions of the arms, the left arm 3 can be placed for installing the web at three positions, i.e. the outermost position IA at left side, ¼ width inwardly shifted position IB shifted in the magnitude of ¼ of the full width of the full width from the left side outermost position, and center position L of the apparatus. Similarly, the right arm 3 can be placed for installing the web at three positions, i.e. the outermost position 1A at right side, ¼ width inwardly shifted position 1B shifted in the magnitude of ¼ of the full width of the full width from the right side outermost position, and center position L of the apparatus. Therefore, the pair of the left and right arms 3, 3 are shiftable at 6 way positions in combination.

In the above-mentioned feeder apparatus, an automating mechanism for automatically shifting the web supporting arms according to the present invention, comprises an arm fixing means A for fixing the arms at selected one of the 6 positions, an arm shifting means B for shifting the arms and a shifting termination detecting means C for detecting the terminating position of the shifting of the arms. The constructions and operations will be discussed herebelow in order.

At first, discussion will be given for the fixing means A for fixing the arms at the selected positions and a releasing means for releasing the arms 3, 3 from the fixed condition.

Figure 2:
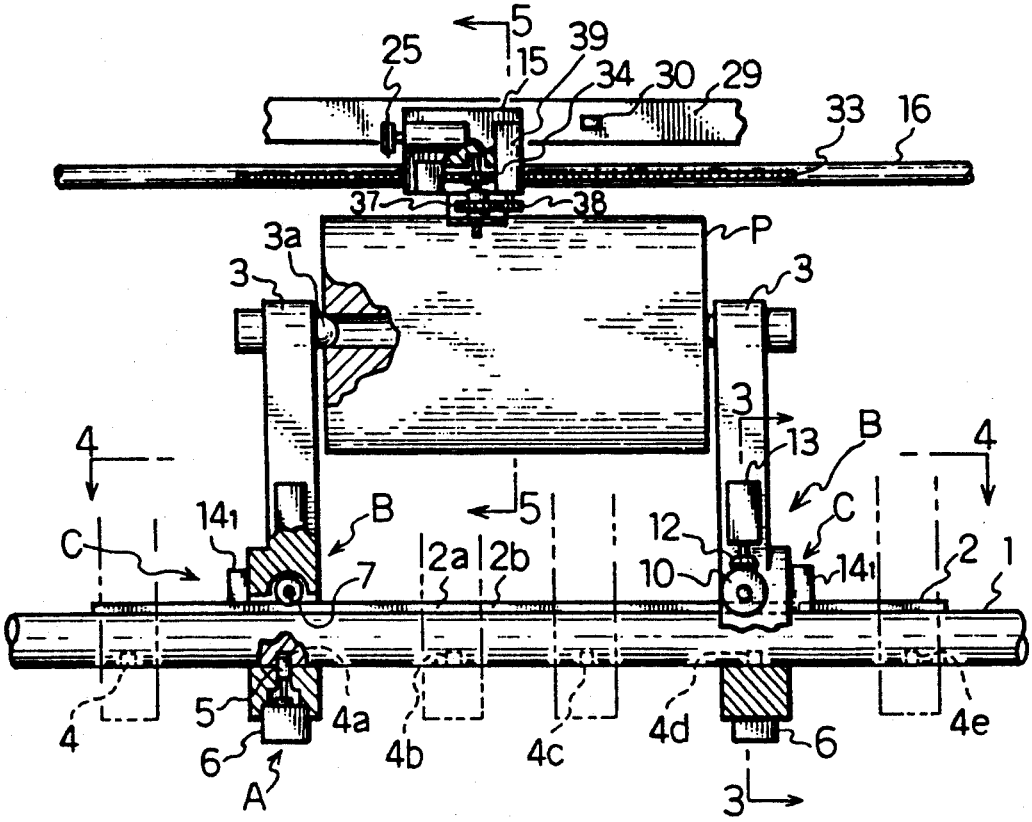
FIG. 2 is a partial front elevation of the feeder apparatus as sectioned along a main shaft in FIG. 1.
Figure 3:
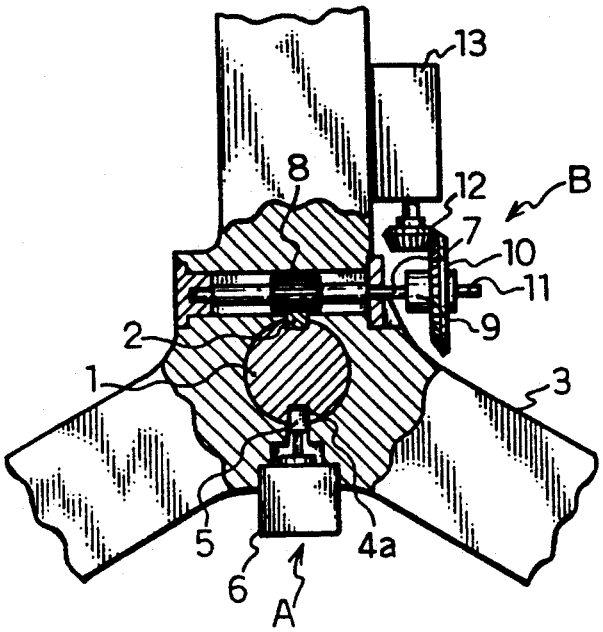
FIG. 3 is an enlarged left side section taken along line 3—3 of FIG. 2.

As shown in FIGS. 2 and 3, six key holes 4, 4*a*, 4*b*, 4*c*, 4*d* and 4*e* are formed on the lower peripheral surface of the main shaft 1. The position of respective of the key holes are determined at corresponding positions of the web supporting arms 3, 3 for supporting the web P. Among these six key holes, the left side three key holes 4, 4*a* and 4*b* are used for fixing the left side arm 3, and the right side three key holes 4*c*, 4*d* and 4*e* are used for fixing the right side arm 3.

On the other hand, in the boss sections of respective arms 3, 3, guide holes are extended radially inward from the lower outer circumference. Through these guide holes, key pins 5, 5 are inserted. The key pins 5, 5 are associated with fluid cylinders 6, 6 which are adapted to externally operate the key pins 5, 5. The fluid cylinders 6, 6 are mounted on the boss sections of the arms respectively. Respective fluid cylinders include rods coupled with the key pins 5, 5 at the tip ends thereof.

Accordingly, at the stop positions of respective arms 3, 3, the fluid cylinders 6, 6 are actuated to extend the rods to push the key pins 5, 5 into the corresponding key holes. Conversely, by actuating the fluid cylinders 6, 6 to retract the rods, the key pins 5, 5 are released away from the key holes so as to permit axial movement of the arms 3, 3.

As shown in FIGS. 1, 2 and 3, the shifting means B for the pair of arms includes a rack 2*a* for shifting the arms is formed on the upper surface of the elongated key 2. On the other hand, through openings are formed at the upper portions of the boss sections of the arms 3, 3, which through openings extend in a direction transverse to the axial direction of the main shaft 1. At essentially central positions in the through openings, pinions 8 are mounted. The pinions 8 are designed to engage with the rack 2*a*. Pinion shafts 7 of the pinions 8 are rotatably supported by means of bearings which are provided at both end portions of the through openings. One end of the pinion shafts 7 are extended through the corresponding bearing to project externally. On the externally projecting portion of the pinion shaft 7, a driven bevel gear 10 is provided via a torque limiter or a clutch 9. Also, the tip end of the externally projecting portion of the pinion shaft 7 is formed into a square or rectangular cross section so that a manual operation handle can be coupled thereto. The driven bevel gear 10 is meshed with a driving bevel gear 12. A gear shaft of the driving bevel gear 12 is coupled with an output shaft of a motor 13. The motor 13 are mounted on the side surfaces of the upwardly directed arm portions of the arms 3, 3.

Accordingly, the rotational output torque of the motor 13 is transmitted to the driven bevel gear 10 via the driving bevel gear 12, and thus transmitted to the shaft 7 via the torque limiter 9. Therefore, the pinion 8 rigidly fixed to the pinion shaft 7 is driven to rotate. The pinion 9 is driven to rotate with maintaining engagement with the rack 2*a*. As a result, the pinion 8 is shifted with the arm 3 along the main shaft 1.

Discussion will be given for the arm stop position detecting means C herebelow.

Figure 4:
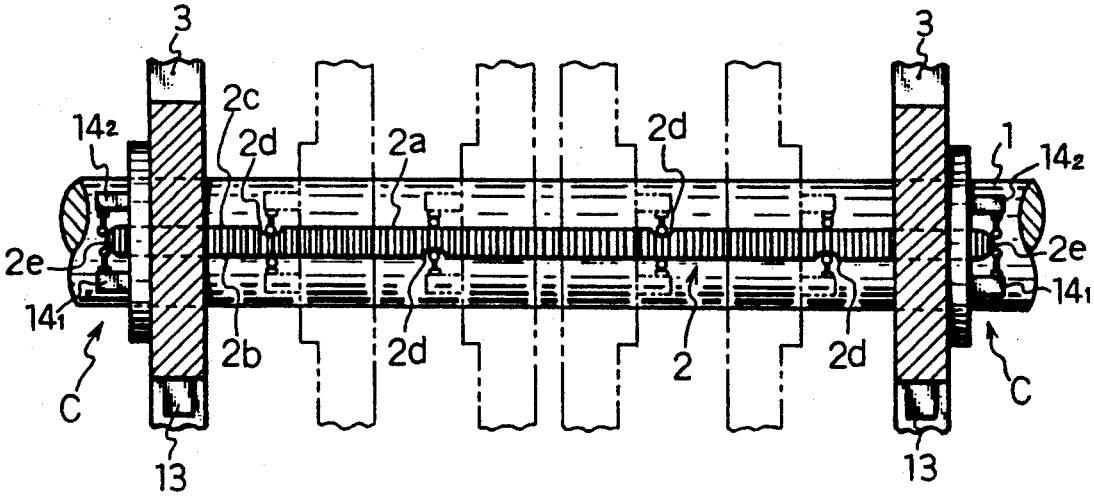
FIG. 4 is an enlarged horizontal section taken along line 4—4 in FIG. 2.

In the embodiment illustrated in FIGS. 1, 2 and 4, particularly in FIG. 4, pairs of limit switches $14_1$, $14_2$ are employed as detecting sensors. The limit switches $14_1$, $14_2$ are mounted on the outer side of boss sections of the arms 3, 3 at both sides of the key groove. The limit switches $14_1$, $14_2$ carry contacts having tip ends held in contact with side edges of the key 2. Therefore, the side edges of the key 2 serves as cam surfaces 2*b* and 2*c* for guiding the tip ends of the contacts. On the cam surfaces 2*b*, 2*c*, markings, such as dents 2*d* or the ends 2*e* are formed at respective positions corresponding to the stop positions of the arms 3, 3 and also corresponds to the positions of the key holes 4, 4*a*, 4*b*, 4*c*, 4*d* and 4*e*. The limit switches $14_1$, $14_2$ are adapted to generate detection signals when the tip ends of the contacts reach the markings 2*d* or 2*e*. As shown in FIG. 4, the stop positions of the left side arm 3 are the left side outermost position 1A on the main shaft 1, the intermediate position 1B or the central position L, and the stop positions of the right side arm 3 are the right side outermost position 1A of the main shaft 1, the intermediate position 1B and the central position L. The detecting signals corresponding to respective positions are generated as combination exemplified in the following table 1.

TABLE 1

| Arm | Cam 2b | LS $14_1$ | Cam 2c | LS $14_2$ | Stop Position |
|---|---|---|---|---|---|
| Left | 2e | OFF | 2e | OFF | 1A |
| Left | — | ON | 2d | OFF | 1B |
| Left | 2d | OFF | — | ON | L |
| Right | — | ON | 2d | OFF | L |
| Right | 2d | OFF | — | ON | 1B |
| Right | 2e | OFF | 2e | OFF | 1A |

As shown in the table 1, in case of the combination of the detecting signals where a pair of limit switches $14_1$ and $14_2$ are both held OFF, it represents the left end position (left side outermost position) 1A in case of the left side arm and the right end position (right side outermost position) 1A in case of the right side arm. In case of the combination of the detecting signals where the limit switch $14_1$ is ON and the limit switch $14_2$ is OFF, it represents the intermediate position 1B in case of the left side arm and the central position L in case of the right side arm. Also, in case of the combination of the detecting signals where the limit switch $14_1$ is OFF and the limit switch $14_2$ is ON, it represents the central position L in case of the left side arm and the intermediate position 1B in case of the right side arm.

Discussion will be given for the process to automatically shifting the pair of arms 3, 3 along the main shaft 1, hereinafter.

Initially, all possible web supporting positions for supporting the web P to be derived from FIG. 4 and the table 1 are preset on a not shown control panel in a form of combination of the limit switches $14_1$ and $14_2$ and ON and OFF states of the limit switches $14_1$ and $14_2$.

Then, the supporting position corresponding to the width of the web P to be installed is selected among the preset positions and set.

Subsequently, through the control panel, a shifting command for the pair of arms 3, 3 is output. In response to the shifting command, the fluid cylinders 6, 6 are actuated to release the arms 3, 3 from the position fixed on the main shaft 1. Also, the motor 13 is responsive to the shifting command to initiate driving to transmit driving torques through the driving bevel gears 12, the driven bevel gears 10 and the torque limiters 11 to the pinions 8. Thus, the pinions 8 of respective arms 3, 3 are rotatingly driven to shift the arm along the rack 2*a*.

According to shifting of the arm 3, 3, the pairs of limit switches $14_1$ and $14_2$ carried therewith are shifted along the cam surfaces 2*b* and 2*c* of the rack 2*a*. When the pair of limit switches $14_1$ and $14_2$ of the arm 3 detect the dent 2*d* or end 2*e* to generate the detecting signal.

When the combination of the detecting signals from the pair of limit switches $14_1$ and $14_2$ becomes coincident with the combination represented by a set signal representative of the desired position of the relevant arm 3, a shifting termination command is generated. In response to the shifting termination command, the fluid cylinder 6 is actuated to protrude the rod to engage the key pin 5 to the key hole 4 formed on the peripheral surface of the main shaft 1. As a result, the arm 3 carrying the key pin 5 is fixed at the desired position on the main shaft 1. Thus, shifting of the arm 3 can be terminated. Fixing of the arm 3 to the main shaft 1 with the shown construction successfully prevent the pinion 8 incorporated in the arm 3 to rotate to displace along the rack 2*a*. Therefore, the rotational torque loaded on the torque limiter 9 grows to be greater than a set torque. Then, slip is caused in the torque limiter so that the torque may not be transmitted from the driven bevel gear 10 to the shaft 7 of the pinion 8.

The motor 13 thus situated in idling state terminates driving in response to a timer signal from a not shown timer which measures a predetermined period and produce the timer signal at the end of the predetermined period.

Automation of shifting of the web drive mechanism D is achieved by a shifting means F, a shifting stop position detecting means E and a fixing means G. The constructions and operations of these elements will be discussed herebelow.

Initially, discussion will be given for the web drive mechanism D. As shown in FIGS. 1, 2, 5 and 6, above the web P installed on the tip ends of the arm sections extending upwardly from the boss sections of the pair of left and right arms 3, 3, a pair of guide bars 16 and 17 are arranged in parallel relationship to the main shaft 1. These guide bars 16 and 17 are also supported on the not shown left and right frames. On the pair of guide bars 16, 17, front and rear ends of a base frame 15 of the web drive mechanism D are supported for sliding movement therealong. A support shaft 18 is rotatably supported in parallel relationship to the guide bar 17 at the rear portion of the base frame 15, in the vicinity of the guide bar 17. Two arms 19, 19 are rotatably supported at the central portion of the support shaft 18 and extended frontwardly. Pulleys 20 and 21 are mounted between the tip ends of two arms 19, 19 and on the central portion of the support shaft 18. An endless belt 22 is stretched between these pulleys 20 and 21. On the other hand, an arm 23 is extended from the arm 19 to form a crank arm. At the tip end of the crank arm, a tip end of a rod of a fluid cylinder 24 is coupled. The base portion of the fluid cylinder 24 is supported inside of the support frame 15. On the other hand, one end of the support shaft 18 is extended externally. On the externally extended end of the support shaft 18, a sprocket wheel 25 is rigidly mounted. A driving power source, such as a motor 26 is provided at the front end of the base frame 15. A sprocket wheel 27 is rigidly secured on the output shaft of the motor 26. An endless chain 28 are stretched between the pair of sprockets 25 and 27 to form a power train.

Figure 5:
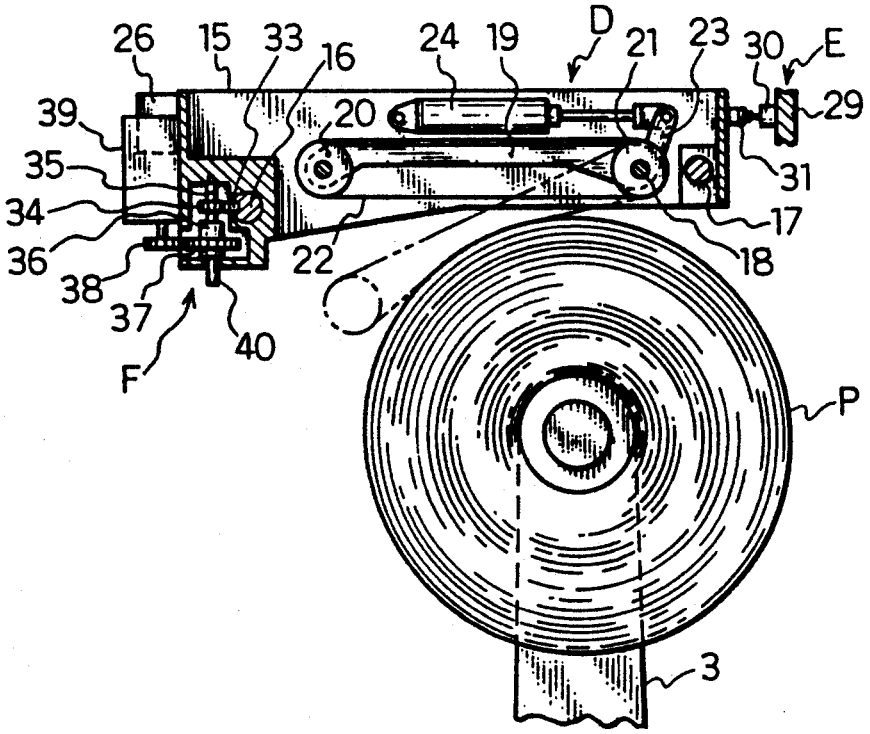
FIG. 5 is a right side section taken along line 5—5 of FIG. 2.

Accordingly, when the fluid cylinder 24 is actuated to retract the rod thereof, the displacement of the rod is transmitted to the two arms 19, 19 via the arm 23 to cause the angular displacement of the arms 19, 19 about the support shaft 18 to the position illustrated by two dotted line in FIG. 5. At this position, the lower surface of the endless belt 22 comes in contact with the peripheral surface of the web P. By driving the motor 26 at this condition, the driving torque is transmitted to the support shaft 18 via the sprocket wheel 27, the endless chain 28 and the sprocket wheel 25. As a result, the pulley 21 rigidly fixed to the support shaft 18 is driven to rotate to drive the endless belt 22. According to rotation of the endless belt 22, the web P is driven to rotate.

On the other hand, when the fluid cylinder 24 is driven to protrude the rod, this motion is transmitted to two arms 19, 19 via the arm 23. Then, the arms 19, 19 are driven to pivot about the support shaft 18 to the position illustrated by the solid line in FIG. 5. Then, the lower surface of the endless belt 22 is released away from the peripheral surface of the web P. Therefore, the driving torque of the motor 26 is never transmitted to the peripheral surface of the web P.

Here, since the webs to be installed between the arms 3, 3 have three different width as illustrated in FIG. 7. Therefore, the operating position of the web driving mechanism D has to be shifted corresponding to the variation of the web width. As illustrated in upper portion in FIG. 7, the shifting position of the web driving mechanism D is preferably at the central position L of the apparatus, and the intermediate position 1B offsetting toward left and right in the magnitude of ½ width. However, it may be practically acceptable to shift between the intermediate positions 1C which are the intermediate position between the positions L and 1B for adapting to all variation of the width of the webs. It should be noted that in the shown embodiment, the web driving mechanism is designed to shift between the intermediate positions 1C, 1C.

Discussion will be given for the shifting means F of the web driving mechanism D herebelow.

At first, rack 33 is provided along the front surface of the guide bar 16. A pinion 34 is meshed with the rack 33. A pinon shaft 35 of the pinion 34 is rotatably supported on the base frame 15. At the intermediate portion of the pinion shaft 35, a torque limiter 36 is provided. A transmission gear 37 is provided on the shaft 35 so that the driving torque can be transmitted from the transmission gear 37 to the pinion 34 via the torque limiter 36. The transmission gear 37 is meshed with a drive gear 38 rigidly secured on an output shaft of a motor 39. On the other hand, the shaft 35 is extended externally beyond the base frame 15. At the externally projected end of the shaft, a square or rectangular shaft portion 40 is formed so that a not shown manual operation handle can be coupled thereto.

The output torque of the motor 39 is transmitted to the transmission gear 37 via the drive gear 38. Then, the driving torque is transmitted to the shaft 35 via the torque limiter 36 to rotatingly drive the pinion 34 which is rigidly secured on the shaft 35. As a result of rotation, the pinion 34 moved along the rack 33. Then, the base frame 15, on which the shaft 35 is rigidly mounted is shifted along the guide bar 16.

The construction and operation of the shifting stop position detecting means E will be discussed herebelow. As shown in FIG. 2, a support plate 29 is arranged at the back side of the rear side guide bar 17. The support plate 29 is secured on the not shown left and right frames at both ends. Limit switches 30, 30 are mounted on predetermined positions of the support plate 29. On the other hand, a cam 31 is projected from the rear end surface of the base frame 15. Therefore, according to movement of the base frame 15, the cam 31 comes into contact with the contact of one of the limit switches 30, 30. Then, the corresponding limit switch 30 turns ON to output the detection signal. The detection signal triggers actuation of a fluid cylinder 41 of the fixing means G which will be discussed later.

Figure 6:
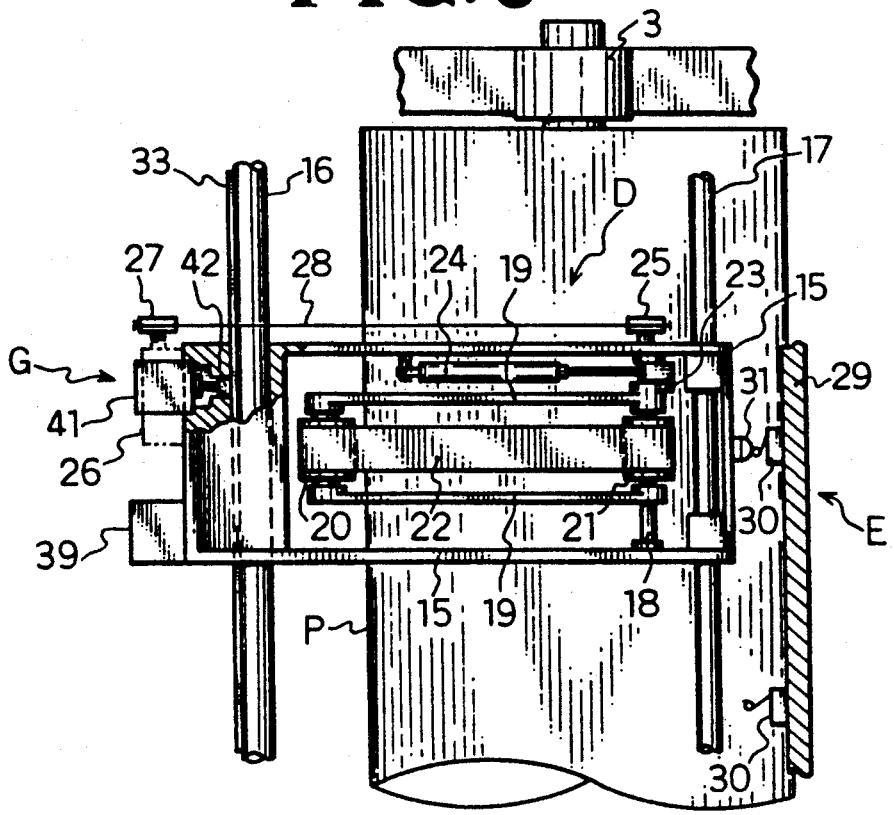
FIG. 6 is a partially cut-out plan view of the structure of FIG. 5.

The followings are the construction and operation of the fixing means G for the web driving mechanism D. As shown in FIG. 6, an opening to reach the rack 33 is formed through the front surface of the base frame 15. The fluid cylinder 41 is fixed to the base frame 15 in opposition to the outer end of the opening. A rod of the fluid cylinder 41 carries a block 42 which is formed of a rack teeth for engagement with the rack 33. Accordingly, when the fluid cylinder 41 is actuated in response to the detection signal set forth above, the block 42 is projected toward the rack 33 to establish engagement for preventing the base frame 15 from further shifting.

Hereafter, discussion will be given for the process of automatic shifting of the web driving mechanism D along the guide bar 16.

Initially, a command signal generated associated with shifting of the arms 3, 3 is applied to actuate the fluid cylinder 41. Then, as shown in FIG. 6, the block 42 carrying the rack teeth is released away from the rack 33 to release locking for the base frame 15. Also, the motor 39 is responsive to the command signal to initiate driving. The driving torque of the motor 39 is then transmitted to the pinion 34 to rotatingly drive the latter. According to rotation of the pinion 34, the base frame 15 is driven to shift along the rack 33.

Associated with movement of the base frame 15, the cam 31 carried therewith is moved to come in contact with the contact of one of the limit switch 30. Then, the corresponding limit switch 30 is turned ON to generate the detection signal. When the detection signal is coincident with a set signal representative of the desired stop position of the base frame 15, the command signal is generated to actuate the fluid cylinder 41 to push the block 42 with the rack teeth toward the rack 33 to establish locking engagement. By this, the base frame 15 is fixed at the corresponding position. Fixing of the base frame 15 to the guide bar 16 prevents the pinion 34 carried with the base frame from rotating. Therefore, the torque applied to the torque limiter 36 becomes greater than a set torque thereof to cause slip therein. As a result, the rotational torque of the transmission gear 37 will never been transmitted to the shaft 35 carrying the pinion 34.

The motor 39 thus in idling condition is stopped in response to a timer signal of a not shown timer which is adapted to measure a predetermined period of time to generate the timer signal upon elapsing of the predetermined period.

As set forth above, according to the present invention, the conventional rack and pinion construction for manual operation for shifting the web supporting arms are maintained, and driving mechanisms are provided for respective arms with detecting means for detecting arm positions on the main shaft to realize automated drive and stop in shifting of the arms. Therefore, automated operation can be attained economically and with simple construction with addition of less number of additional parts. In addition, since the present invention permits simultaneous adjustment of the arm positions, it improves efficiency of installation of the web. Furthermore, since the shown invention permits manual operation in case of failure in the automated system. In addition, the arm is certainly prevented from play movement by the fixing means according to the invention, high reliability can be attained for contributing for power and labor saving.

Furthermore, the present invention further realize automation of shifting of the web driving mechanism associated with the arm shifting means with simple and inexpensive construction. In addition, even when failure is caused in the automated mechanism, it permits manual operation in adjusting the position of the web driving mechanism. Therefore the present invention should be of significant value as practical machine in the newspaper printing industry which requires speeding operation.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

For instance, in the above-mentioned preferred embodiment, the torque limiters 9 and 36 as a kind of skip coupling are employed to cooperate with the fixing means for interruption of the torque transmission associated with stopping at the desired positions of the web supporting arms and the web driving mechanism with simple construction and smooth operation. However, the torque limiter in the shown embodiment may be replaced with another other slip coupling or clutch mechanism although a little more associated mechanism will be required.

What is claimed is:

1. A feeder apparatus for a web rotary press, which includes a pair of web supporting arms mounted on a main shaft supported on left and right frames and independently movable along the main shaft by interpositioning of an elongated key and by meshing of a rack provided along said main shaft and pinions provided in boss sections of respective arms, wherein said feeder apparatus comprising:

arm shifting means for rotatingly driving respective of pinions independently, said arm shifting means including driving portions arranged at or in the vicinity of said boss sections of respective arms;

arm shifting stop position detecting means including sensors provided on respective arms and marking portions provided on predetermined positions of said main shaft corresponding to both of variation of the width of webs to be installed and variation of installation positions thereof, for generating a command for stopping shifting of said arms when a detecting signal attained in relation to shifting of respective arms and a predetermined signal are coincident with each other; and arm fixing means in response to said command for releasably fixing respective arms at stop positions on said main shaft.

2. A feeder apparatus as set forth in claim 1, wherein a shaft supporting said pinion has a polygonal shaft portion for manual operation.

3. A feeder apparatus as set forth in claim 1, wherein said arm shifting means includes a torque limiter provided between said pinion and shaft thereof for blocking torque transmission in response to fixing of said arm by said fixing means.

4. A feeder apparatus as set forth in claim 1, wherein said arm shifting means includes a clutch mechanism for blocking torque transmission in response to fixing of said arm by said fixing means.

5. A feeder apparatus as set forth in claim 1, wherein said markings provided on said main shaft are provided at three positions for a left side arm and at another three positions for a right side arm.

6. A feeder apparatus as set forth in claim 1, which further comprises:

web driving means including a guide bar supported by the left and right frames in parallel relationship to said main shaft, a base frame supported by said guide bar for shifting in axial direction of said guide bar, an endless belt mounted on said base frame for contacting and releasing to and from the peripheral surface of said web and a driving portion for driving said endless belt;

base frame shifting means including a drive portion, for shifting said base frame along said guide bar;

brake frame shifting stop position detecting means including a plurality of sensors arranged at a plurality of pre-selected positions adapted to variation of the width of the web to be installed and variation of the installation position, markings provided on said base frame, for generating a stop command for stoppinq shifting of said base frame when a detection signal attained in relation to shifting of said base frame and a predetermined set signal are coincident to each other; and base frame fixing means for releasably fixing said base frame on said guide bar in response to said stop command.

7. A feeder apparatus as set forth in claim 6, wherein said base frame shifting means comprises a rack provided on said guide bar, a pinion provided on said base frame and meshing with said rack and a driving portion for rotatingly driving the shaft of said pinion.

8. A feeder apparatus as set forth in claim 7, wherein said shaft supporting said pinion has a polygonal shaft portion for manual operation.

9. A feeder apparatus as set forth in claim 7, wherein said base frame shifting means includes a torque limiter provided between said pinion and said shaft thereof for blocking torque transmission therebetween in response to fixing of said base frame by said fixing means.

10. A feeder apparatus as set forth in claim 7, wherein said base frame shifting means includes a clutch mechanism provided between said pinion and said shaft thereof for blocking torque transmission therebetween in response to fixing of said base frame by said fixing means.

* * * * *